US006622407B2

(12) United States Patent
Liang

(10) Patent No.: US 6,622,407 B2
(45) Date of Patent: Sep. 23, 2003

(54) RUBBER PLUG FOR A WATER BALL TO PREVENT FROM HAVING BUBBLES

(75) Inventor: Cheng Liang, Taipei (TW)

(73) Assignee: Seagull Decor Co., Ltd., Taipei (TW)

( * ) Notice: Subject to any disclaimer, the term of this patent is extended or adjusted under 35 U.S.C. 154(b) by 0 days.

(21) Appl. No.: 10/059,002

(22) Filed: Jan. 30, 2002

(65) Prior Publication Data

US 2003/0140533 A1 Jul. 31, 2003

(51) Int. Cl.[7] ..... G09F 19/00

(52) U.S. Cl. ..... 40/406

(58) Field of Search ..... 40/409, 410, 406, 40/411, 414; 446/267

(56) References Cited

U.S. PATENT DOCUMENTS

| | | | | | |
|---|---|---|---|---|---|
| 5,967,088 | A | * | 10/1999 | Lin | 40/406 |
| 5,971,831 | A | * | 10/1999 | Hsu | 40/406 |
| 6,001,433 | A | * | 12/1999 | Meng | 40/406 |
| 6,061,937 | A | * | 5/2000 | Meng | 40/409 |

* cited by examiner

*Primary Examiner*—Gary Hoge
(74) *Attorney, Agent, or Firm*—Troxell Law Office PLLC

(57) ABSTRACT

A rubber plug for a water ball to prevent from having bubbles, which comprises a plurality of glue plates for gluing an ornament, and then is assembled together with a glass ball in water; the rubber plug has a buffer membrane under the glue plates, and extending downwards; the buffer membrane can provide a buffer space to prevent the water ball from having bubbles upon the water in the water ball being frozen in winter to cause a distension.

7 Claims, 8 Drawing Sheets

RUBBER PLUG FOR A WATER BALL TO PREVENT FROM HAVING BUBBLES

BACKGROUND OF THE INVENTION

1. Field of the Invention

This invention relates to an ornamental water ball, and particularly to a rubber plug for a water ball to prevent from having bubbles.

2. Description of the Prior Art

A conventional ornamental water ball usually comprises a glass ball having a round neck part furnished with a positioning ring and a seal plug, which are assembled together in water; the edge of the seal plug has a positioning ring and a salient ring to be mounted fixedly on the neck part of the glass ball; the water in the glass ball is isolated from the atmosphere. The ornamental water ball has an ornamental body portion with a cylindrical hole, in which the neck part of the glass ball is mounted, and sealed in place with a silicone. The bottom of the ornamental body portion is usually mounted with a music device, which can provide a short piece of music upon the spring motor thereof being wound up.

In a conventional ornamental water ball, all parts thereof are put in a water tank before the glass ball and the water-proof plug being assembled so as to prevent from air left in the glass ball, and to prevent from having bubbles left on the water-proof plug and the ornament. After the neck part of the glass ball and the water-proof plug are assembled together, no water is leaked out because of the water-proof plug is made of a resilient and hermetical material; in that case, no bubbles left in the glass ball is all right, but the density of the water varies with the temperature; particularly, the density of water would contract or distend to some extent during summer or winter because of temperature variation. When the temperature is varying, the water in the glass ball will also vary; in case of the pressure of contraction or distension being greater than the hermetic strength between the glass ball and the water-proof plug. The glass ball would leak or suck in air; in that case, the glass ball would become an air chamber.

In a conventional ornamental water ball, the flat plate of the water-proof plug is furnished with a plurality of grooves made of a thin material; the grooves would contract or distend simultaneously with the water during summer or winter; however when most part of the top surface of the water-proof plug is furnished with such grooves, the surface for gluing an ornament would be reduced; then, the ornament is subject to separating from the glued surface.

SUMMARY OF THE INVENTION

The prime object of the present invention is to provide a rubber plug for a water ball to prevent from having bubbles, in which the bottom of an ornament is glued to a glue plate on the rubber plug; then, the ornament and a glass ball are assembled together in water; a buffer membrane is furnished under the glue plates of the rubber plug to provide a buffer space, and it is used for removing bubbles in the water ball upon the water being frozen in winter.

Another object of the present invention is to provide a rubber plug for a water ball to prevent from having bubbles, in which the glue plates on the rubber plug are furnished in equal and separate manner; the glue plates have a given thickness for gluing an ornament thereon so as to prevent the ornament from slanting or separating upon the water in the water ball being frozen to cause a distension pressure.

Still another object of the present invention is to provide a rubber plug for a water ball to prevent from having bubbles, in which the bottom of an ornament is glued to the thick glue plates; a round and concave buffer membrane is furnished under the glue plates; the buffer membrane can provide a resilient buffer space for receiving the distension pressure of the water frozen into ice during water.

A further object of the present invention is to provide a rubber plug for a water ball to prevent from having bubbles, in which a partition groove is furnished between two glue plates, and is under the bottom of an ornament; the connected portion between the partition groove and a ring groove has a wider groove, which is in communication with a hollow space of the buffer membrane so as to provide a wide communication passage between the buffer membrane and the glass ball; when the water inside the glass ball is frozen in winter, the distended water will flow into the buffer membrane via the communication groove so as to prevent the pressure in the space above the rubber plug from increasing too high.

A still further object of the present invention is to provide a rubber plug for a water ball to prevent from having bubbles, in which the rubber plug mounted in the neck part of the glass ball has a plurality of glue plates, under which a buffer membrane is furnished; the buffer membrane is a concave disk extended downwards, and the bottom thereof is a flat plate; the concave disk can provide a buffer space upon the water inside the glass ball being frozen and distended in winter.

Yet another object of the present invention is to provide a rubber plug for a water ball to prevent from having bubbles, in which the rubber plug mounted in the neck part of the glass ball has a plurality of glue plates, under which a buffer membrane is furnished, and the buffer membrane extends downwards to form into a concave disk, which has a short flat surface extended inwards, and then extended upward into a thin and salient disk, which is used to provide a buffer space upon the water being frozen and distended.

Yet still another object of the present invention is to provide a rubber plug for a water ball to prevent from having bubbles, in which the rubber plug mounted in the neck part of the glass ball has a plurality of glue plates, under which a buffer membrane is furnished, and the buffer membrane extends downwards from the ring plate to form into a concave disk, and the bottom of the concave disk extended inwards to form into a semi-spherical salient disk, which is used as a buffer space upon the water being frozen and distended.

Yet a still further object of the present invention is to provide a rubber plug for a water ball to prevent from having bubbles, in which the glue plates in the center of the rubber plug are divided into equal and separate plates by means of partition grooves, and the center intersection of the partition grooves is a cylindrical hole which facilitates demolding upon casting the rubber plug.

DETAILED DESCRIPTION OF THE PREFERRED EMBODIMENT

Figure 1:
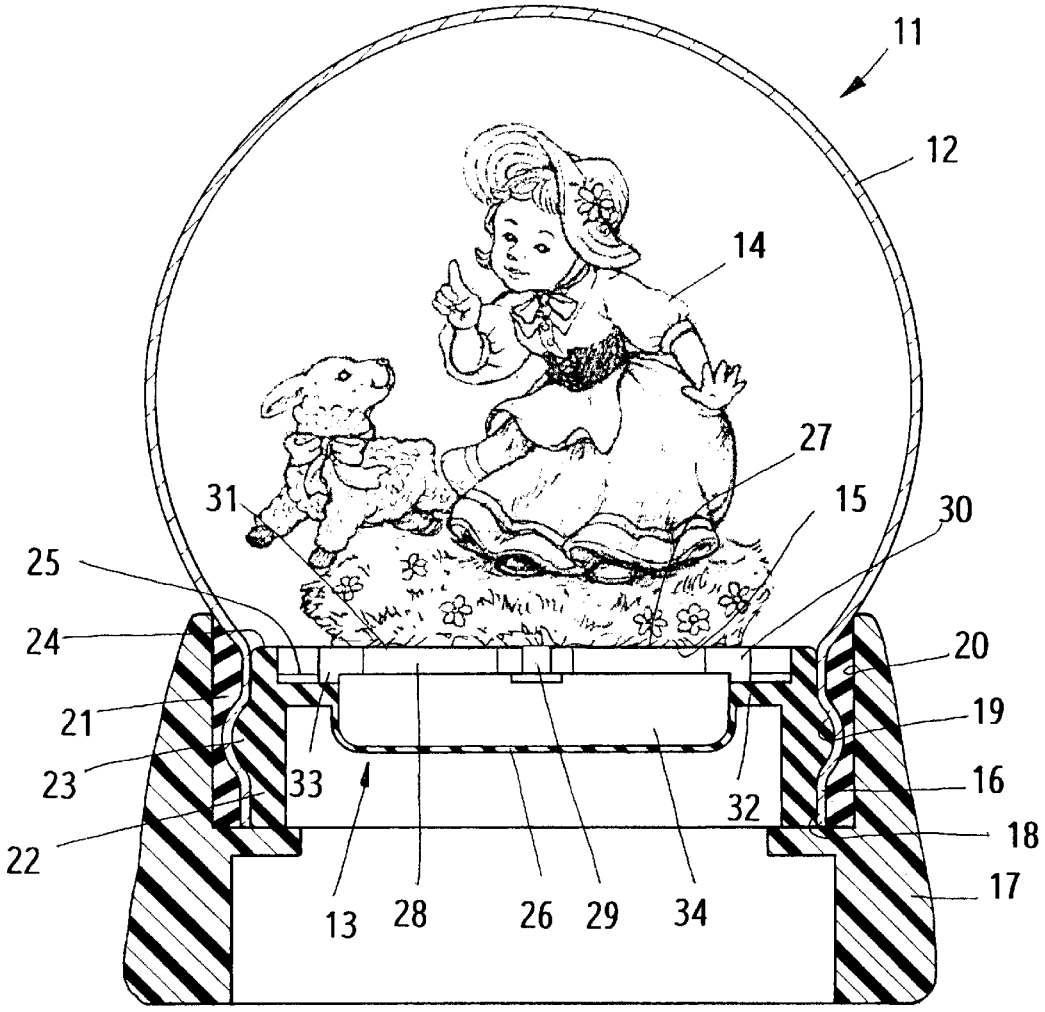
FIG. 1 is a sectional view of the present invention, showing the structure relation between the glass ball and the rubber plug.
Figure 2:
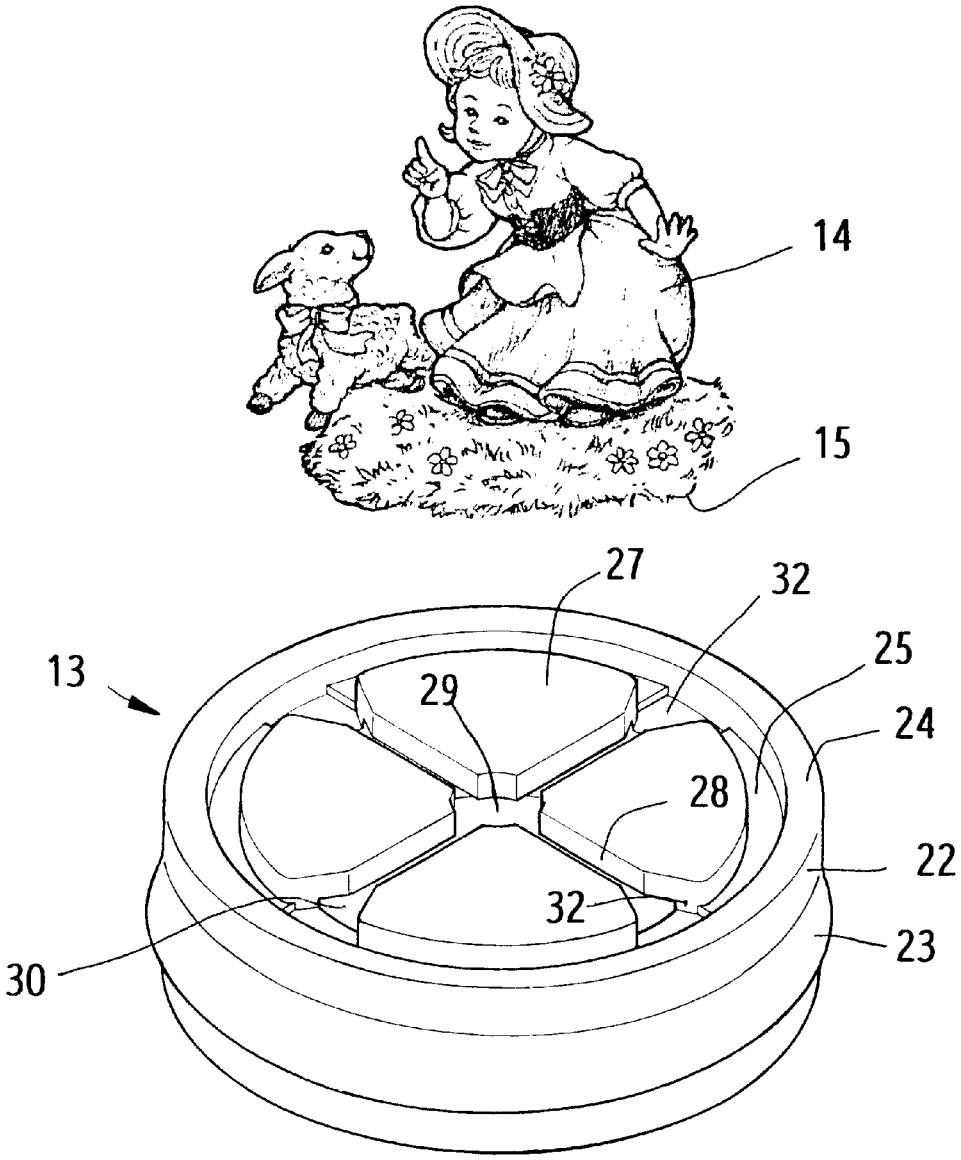
FIG. 2 is a disassembled view of the present invention, showing an ornament separated from the rubber plug.

This invention relates to a rubber plug for a water ball without bubbles; as shown in FIGS. 1 and 2, the bottom surface 15 of an ornament 14 is glued to the plate surface 31 of a plug plate 27 in the center of the rubber plug 13; then, the ornament and the glass ball 12 are put in water so as to have the rubber plug 13 mounted in the neck part 16 of the glass ball 12; the rubber plug 13 can be hermetically mounted together with an inner surface 18 and a ring groove 19 of the neck part 16 of the glass ball 12 by means of a round cylinder 22 and a salient ring 23; then, the neck part 16 of the glass ball 12 is mounted on a body portion 17 with ornamental feature. The ornament 14 in the glass ball 12 can be enlarged by means of the lens effect of water in the glass ball 12 so as to be used as a house ornament.

As shown in FIGS. 1 to 5, the water filled fully in the glass ball 12 of the water ball 11 is subject to freezing into ice in winter, and the ice therein would distend. After the ice is melted into water, the inside of the water ball 11 will have bubbles in case of the water ball not being furnished with a distension space for the ice. In order to prevent the water ball 11 from yielding bubbles, the center of the inner surface 18 of the neck part 16 of the glass ball 12 is furnished with a ring groove 19; the neck part 16 of the glass ball 12 is mounted with a round cylinder 22 of the rubber plug 13; the mid-portion of the round cylinder 22 is furnished with a salient ring 23, which has a catching and a resilient functions so as to have the rubber plug 13 sealed and fixed on the neck part 16 of the glass ball 12 in order to prevent the water in the water ball 11 from leaking out.

After the rubber plug 13 is mounted on the neck part 16 of the glass ball 12, the center of the rubber plug 13 has a sufficient hollow space, which is used as a distension space for water being frozen into ice during winter; in other words, the buffer membrane 26 in the center of the rubber plug 13 is used to provide a distension space without affecting or changing the flatness of the ornament 14 on the glue plate 27 of the rubber plug 13.

The inner top of the round cylinder 22 of the rubber plug 13 is furnished with a ring plate 32 having a given thickness. A round surface 24 having a suitable height is furnished between the outer edge of the ring plate 32 and the round cylinder 22. The round surface 24 and the inner shoulder of the neck part 16 are in registration position, which is used as the reference level for mounting the ornament 14 in the glass ball 12.

Within the round surface 24 of the round cylinder 22 of the rubber plug 13, there is a ring plate 32 having a suitable thickness; within the ring plate 32, there are symmetrical glue plates 27; under the glue plates 27, a buffer membrane 26 is furnished; the glue plates 27 extend upwards from the ring plate 32 to form into a cylinder body 33. The plate surface 31 of the glue plate 27 and the round surface 24 of the round cylinder 22 are on the same level, and they extend upwards in equal and separate portion; the thickness of the cylinder body 33 and the glue plates 27 is almost equal to that of the ring plate 32 so as to provide more glue area for the bottom surface 15 of the ornament 14 upon gluing the same. When the water in the glass ball 12 is frozen into ice during winter, the distended ice would not cause the cylinder body 33 and the glue plates 27 to deform because of the thickness thereof.

The buffer membrane 26 extended downwards from the inner side of the ring plate 32 of the rubber plug 13 has a given depth from the inner surface of the cylinder body 33; the buffer membrane extended downwards from inner side of the ring plate 32 is made of a resilient material; after the glass ball 12 is filled with water, a person may touch the buffer membrane with a finger; in that case, the shape of the buffer membrane can vary with the pressure. Consequently, the buffer membrane can provide a distension space automatically upon the water in the glass water being frozen into ice.

In addition to the buffer membrane 26 able to provide a sufficient distension space for the water frozen in the glass ball 12, the glue plates 27 are made of several equal and separate plates with a suitable thickness, and they can provide a wide plate surface 31 to facilitate the bottom surface 15 of the ornament 14 to glue without causing the glue plates 27 to deform upon the water being frozen; in other words, the beautiful outer view of the water ball 11 would not be damaged.

The buffer membrane 26 of the ring plate 32 and the glue plates 27 are substantially a combination of the rigid material for mold and the membrane 13 material; the center of the equal and separate glue plates 27 of the rubber plug 13 has a cylindrical hole 29, which is substantially the spindle of the mold. The hollow space 34 under the glue plates 27 of the rubber plug 13 is the pull rod position of the spindle after demolding; the partition groove 28 among the equal and separate glue plates 27 is the position of a cross connection plate of the mold. By means of the cross connection plate, the rubber plug 13 can be demolded; since the cross connection plate has a given strength, it can facilitate the rubber plug 13 to be demolded easily; then, the rubber plug 13 would have a wide glue surface and a distension space for frozen water.

Figure 3:
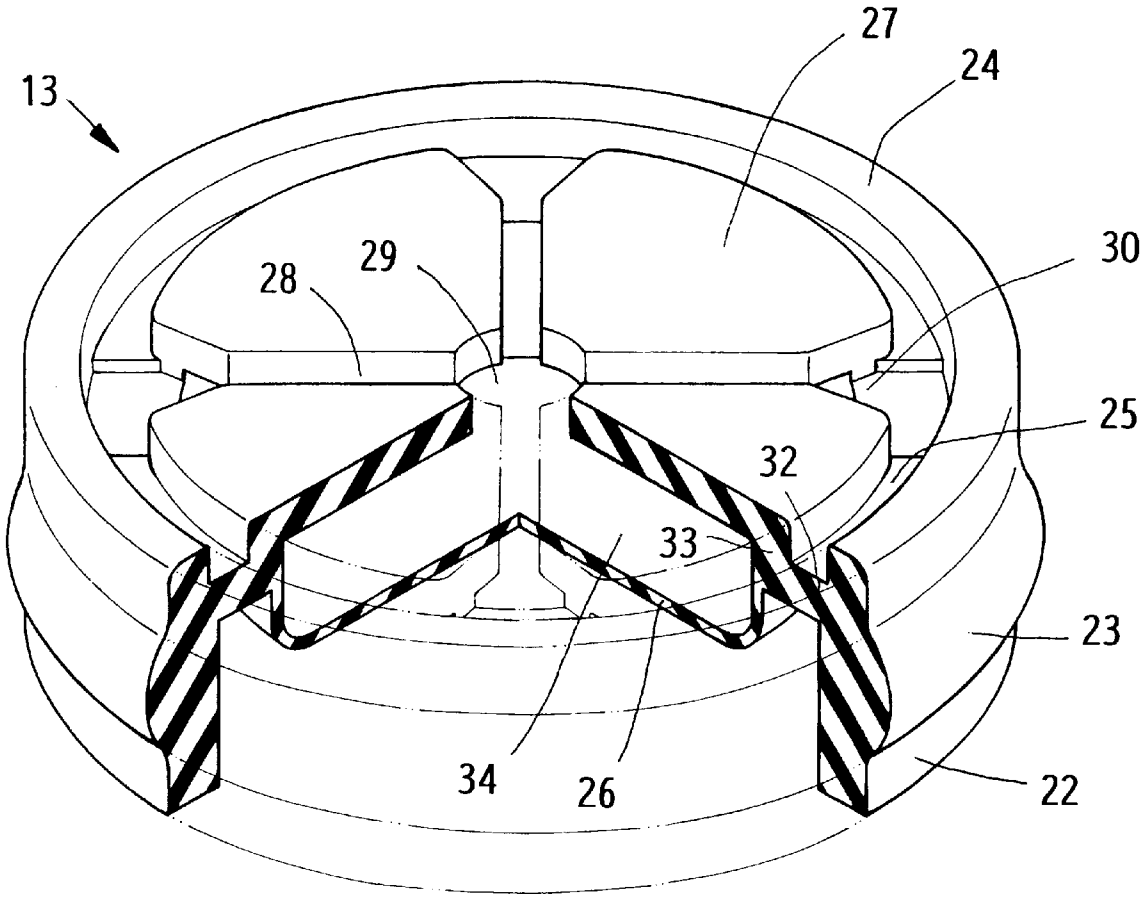
FIG. 3 is a fragmental section view of the present invention, showing the structure of the rubber plug.
Figure 4:
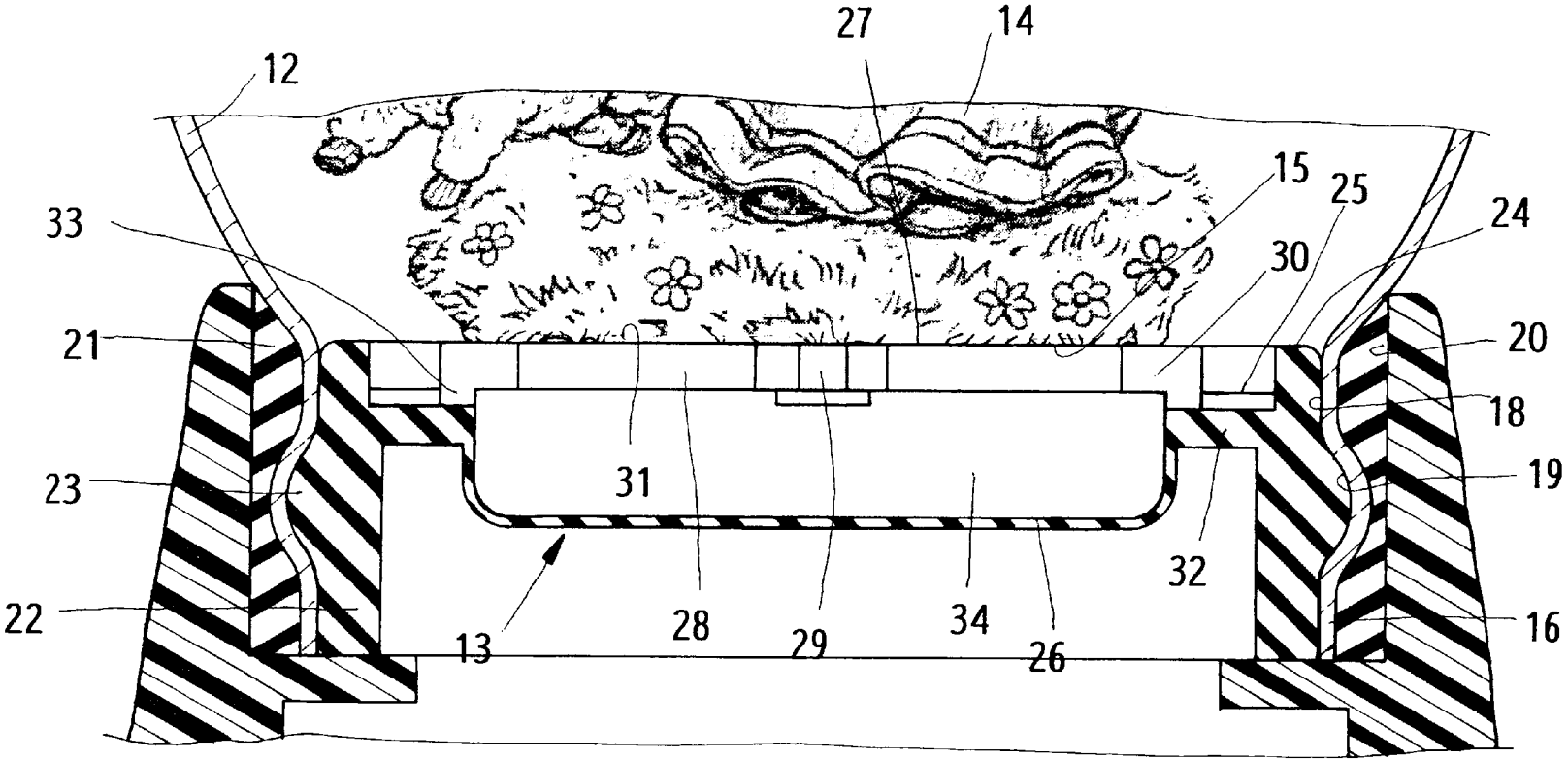
FIG. 4 is a sectional view of the present invention, showing the rubber plug mounted in the neck part of the glass ball.
Figure 5:
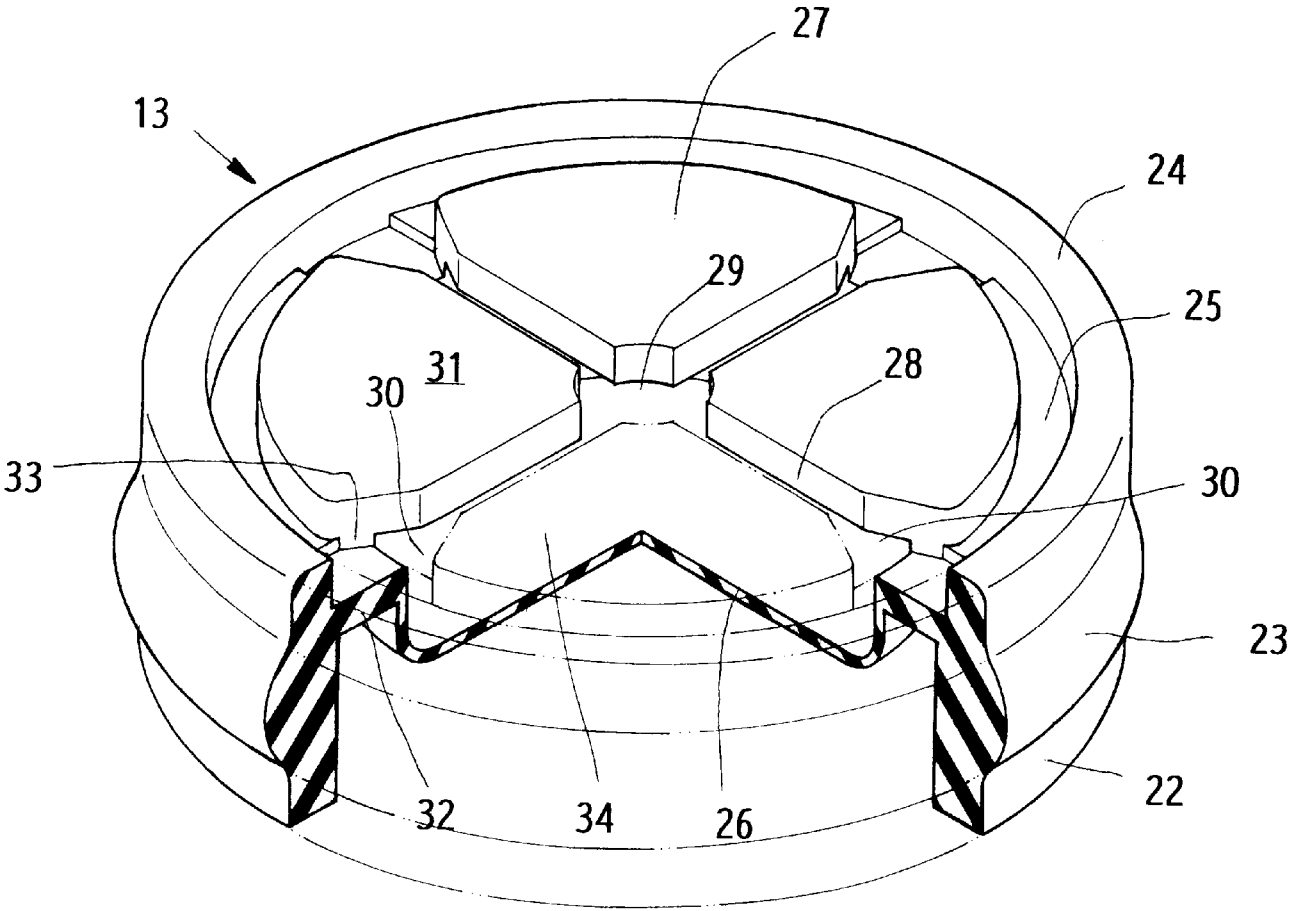
FIG. 5 is a fragmental section view of the present invention, showing the structure of the rubber plug.

As shown in FIGS. 3 and 4, the glue plates 27 are separated by means of the partition groove 28. After an ornament 14 is glued to the plate surface 31 of the glue plates 27, the ornament will cover the whole plate surface 31 of the glue plates 27. If there is no wide passage between the inner space of the glass ball 12 and the hollow space 34 in the rubber plug 13, the buffer membrane 26 under the glue plates 27 would be useless upon the water in the glass ball 12 being frozen.

In order to provide a wide passage between the glass ball 12 and the buffer membrane 26, a plurality of triangular communication grooves 30 are furnished between the partition grooves 28 of every two glue plates 27 and the ring groove 25 around the glue plates 27. The connection part between the ring groove 25 and the communication groove 30 is designed particularly to be slightly lower than the level of the lower surface of the glue plate 27. The communication groove 25 takes a small section of the partition groove 28, and that small section extends divergently towards the ring groove 25 so as to have the communication area between the ring groove 25 and the hollow space 34 become wiser. After the ornament 14 covers the passage-way of the communication grooves 30, the passage-way between the ring groove 25 around the glue plates 27 and the glue plates 27 is still wide enough.

Before the water in the glass ball 12 being frozen, the temperature thereof has to reduce to zero degree (0° C.); when the water inside the glass ball 12 becomes ice gradually from the surface of the ball to the inside thereof, the water therein will distend; then, the ice distended needs a buffer space, and then the wide communication grooves 30 will meet the requirement of distension. As a result of the hollow space 34 furnished between the communication grooves 30 and the buffer membrane 26, the ornament 14 would not be deformed upon the ice in the glass ball 12 distending.

The glue plates 27 for gluing the ornament 14 extend upwards from the ring plate 32 as a cylinder body 33; the glue plates 27, the cylinder body 33 and the ring plate 32 are molded into one piece having a suitable thickness so as to prevent from deforming upon the water in the glass ball 12 being frozen and distending.

From the point of view of mold structure, the communication grooves 30 between the partition grooves 28 and the ring groove 25 have a strong and thick end so as to increase the strength of the ends of the connection plates; furthermore, the glue plates 27 on both sides of the communication grooves would reduce the resistance upon demolding so as to prevent the ends on both sides of the glue plates 27 from being torn.

As shown in FIGS. 1 to 5, the inner edge of the ring plate 32 of the rubber plug 13 is furnished with a cylinder body 33 extended upwards with a plurality of equal and separate glue plates, between every two of which a wide communication groove 30 is furnished so as to have the ring plate 32 and the hollow space 34 of the buffer membrane 26 communicated, and to furnish a distension space between the communication grooves 30 and the hollow space 34 upon the water in the water ball 11 being frozen into ice to distend. In that case, the inner pressure of the glass ball 12 will be reduced, i.e., the distension pressure of the ice will be directed into the hollow space 34 of the buffer membrane 26; therefore, the ornament 14 on the glue plates 27 would not be affected by the distension pressure at all; since the glue plates 27 have a wide and thick plate, they would not be deformed with the distension pressure, and the ornament 14 on the rubber plug 13 will not be biased or separated from the glue plates.

Figure 6:
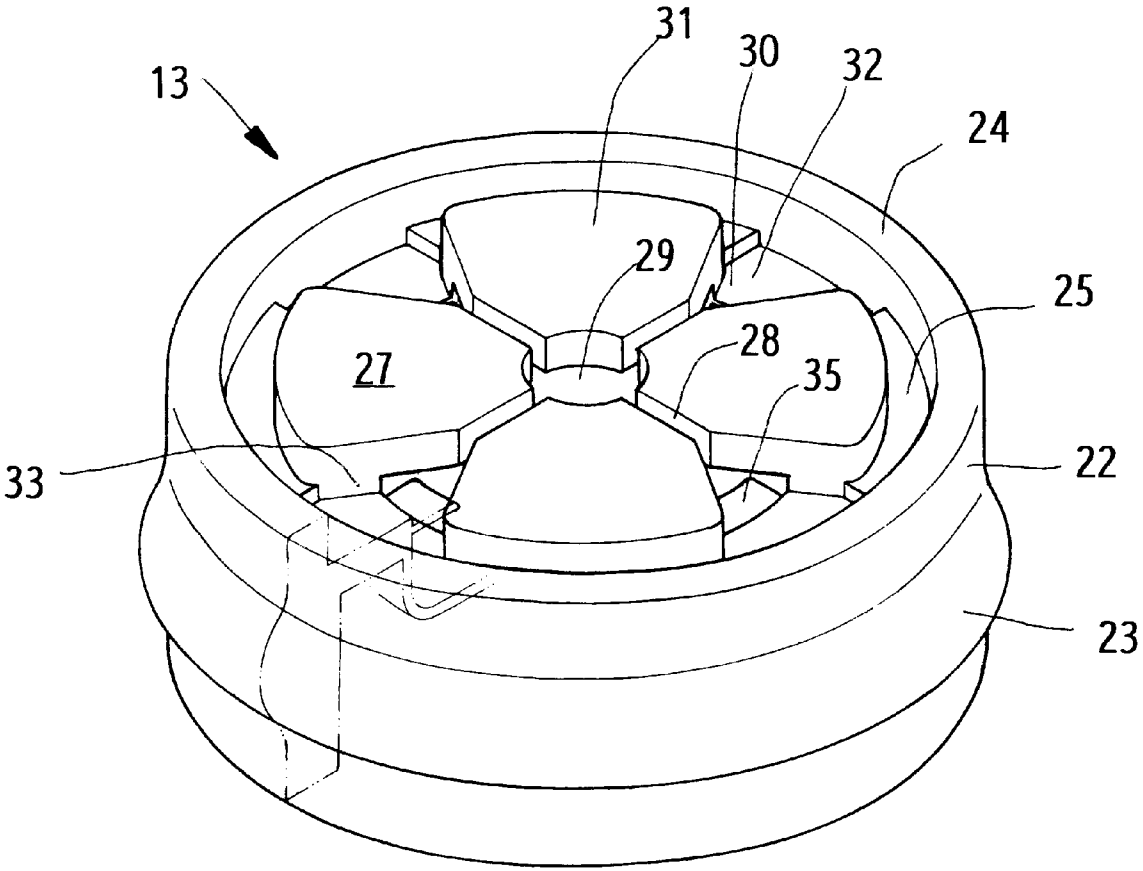
FIG. 6 is perspective view of the present invention, showing another embodiment of the rubber plug, on which glue plates are furnished.

As shown in FIGS. 1 and 6, if the diameter of the rubber plug 13 on the neck part 16 is different from that of the glass ball 12, further consideration should be given to the size of the rubber plug 13, the area of the communication groove 30, the glued area for the ornament 14, and the exposed portion of the communication groove 30; in other words, a dark part under the glue plate 27 should be removed by furnishing a thin plate 35 between the communication groove 30 and the ring plate 32.

Figure 7:
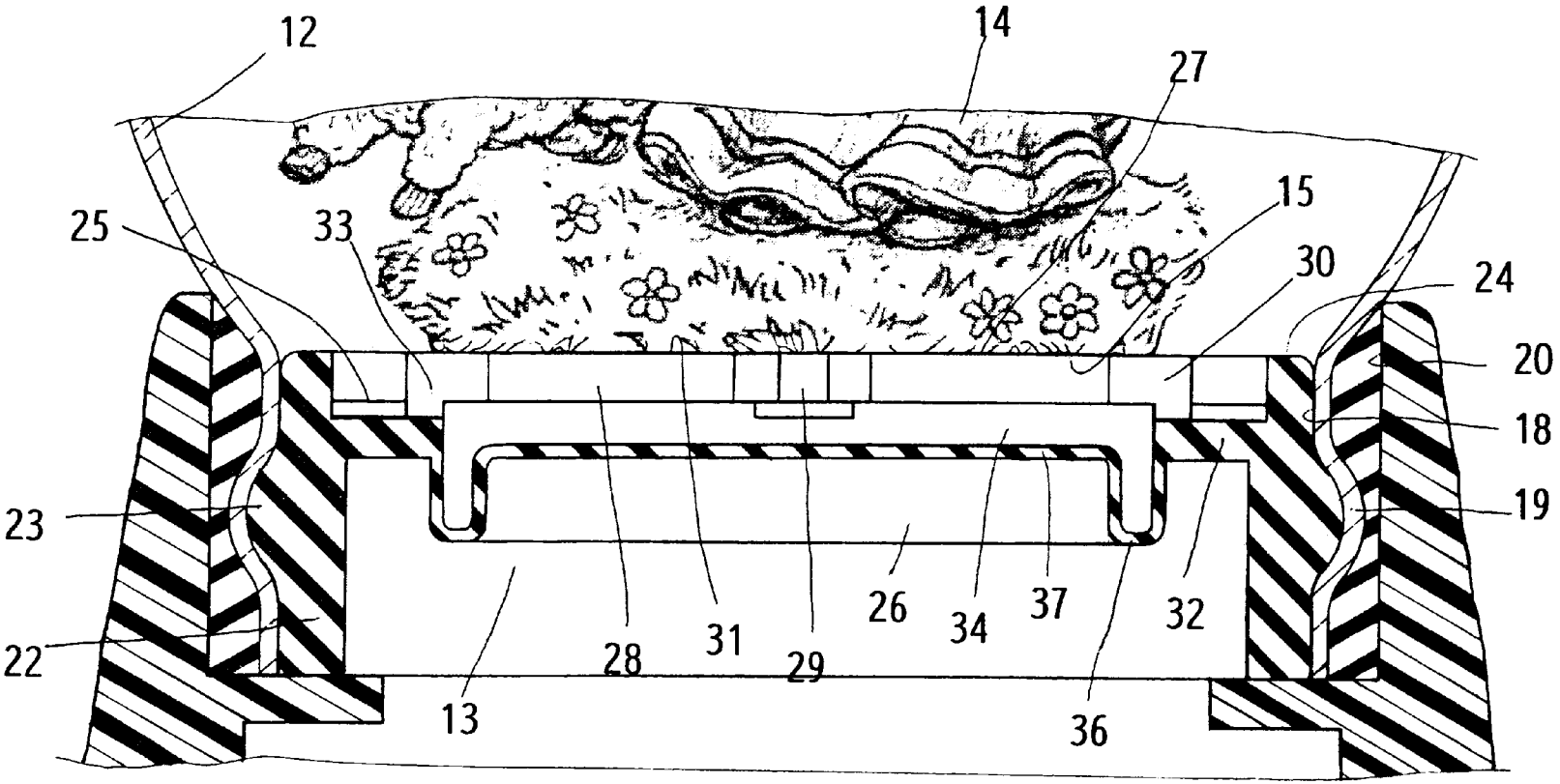
FIG. 7 is a sectional view of the present invention, showing the second embodiment of the buffer membrane in the center of the rubber plug.
Figure 8:
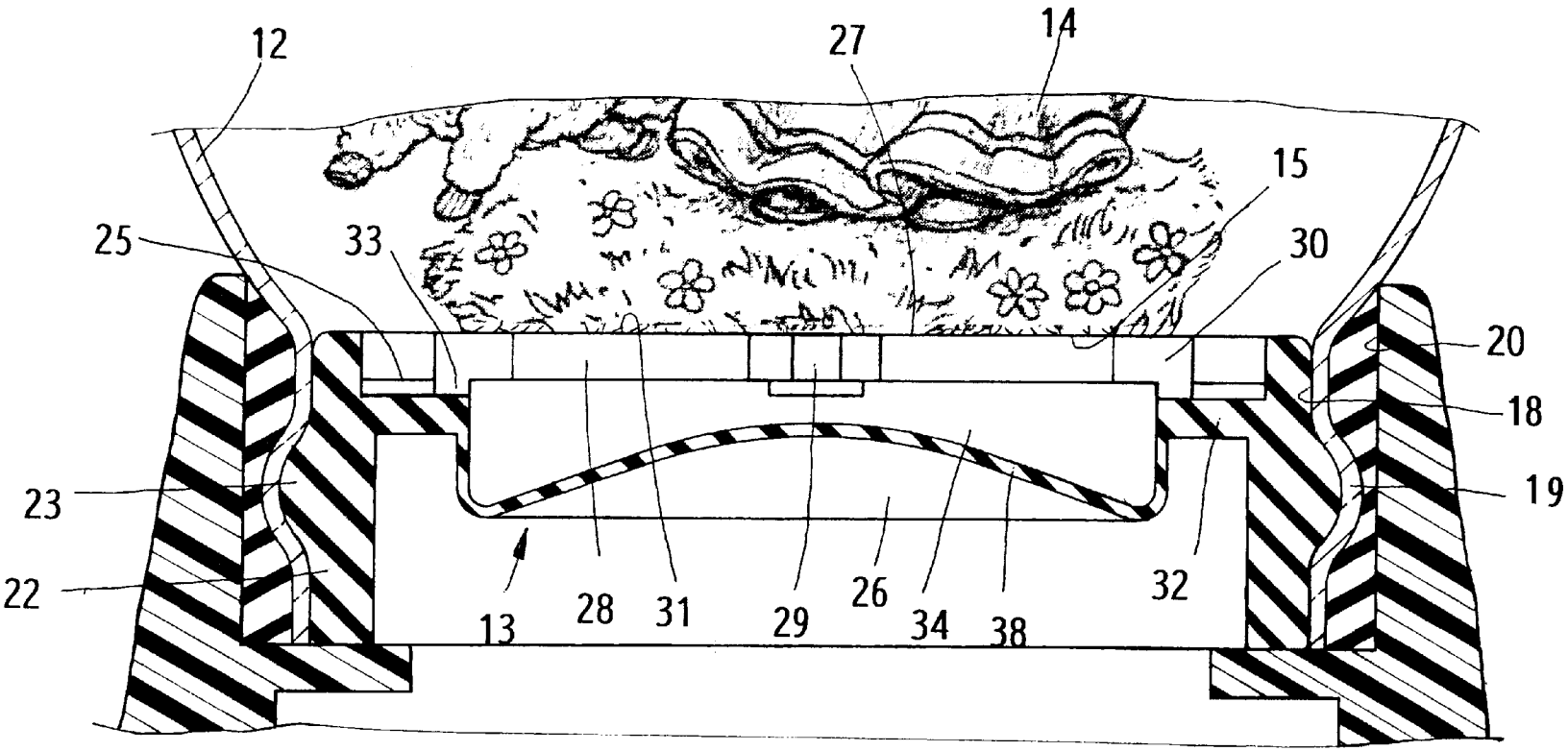
FIG. 8 is a sectional view of the present invention, showing the third embodiment of the buffer membrane in the center of the rubber plug.

As shown in FIG. 7, the buffer membrane 26 under the glue plates 27 of the rubber plug 13 extends downwards from the inner edge of the ring plate 32, and has a concave disk with a short flat surface 36 extended inwards to form into a salient disk surface 37; the thin and salient disk surface 37 can provide a distension space upon the water being frozen. As shown in FIG. 8, the ring plate 32 extends downwards to form into a semi-spherical salient surface 38, which can provide a buffer space upon the water being frozen.

After the water ball 11 is filled fully with water, the neck part 16 of the glass ball 12 is mounted in place in accordance with the aforesaid embodiment, the ornament 14 glued to the glue plates 27 of the rubber plug 13 would not deform. The distension space for the water frozen is provided by means of the wide communication groove 30 and the buffer membrane 26 under the glue plates 27. The ice in the water ball 11 will be melted into water again upon the ambient temperature rising to the normal temperature; then, the buffer membrane 26 in the rubber plug 13 will restore to its original shape; the round cylinder 22 and the salient ring 23 in the neck part 16 of the glass ball 12 would not be affected by the frozen water in winter. When the ice is melted into water, the glass ball 12 would not have bubbles.

According to the description of the aforesaid embodiments of the present invention, the features and structural relation thereof have been disclosed completely; the present invention has provided an apparent improvement of the kind, and it is never anticipated and accomplished by any person in the field; therefore, the structure of the present invention is deemed unique.

What is claimed is:

1. A rubber plug for water ball to prevent from having bubbles, and said rubber plug mounted in an inner surface of a neck part of a glass ball hermetically by means of a round cylinder, a salient ring; upper part of said round cylinder having a ring plate which including:

a plurality of equal and separate glue plates extended upwards; said cylinder body and said glue plates having a given thickness, and said glue plates having flat surfaces to be glued with an ornament;

a buffer membrane extended downwards from said ring plate to form into a concave disk;

a partition groove furnished between two equal and separate glue plates, and connected with a hollow space of said buffer membrane; central part of said glue plates being a communicated space, and outer edge thereof being connected with a ring groove; and a communication groove connected between said ring groove and said buffer membrane.

2. A rubber plug for a water ball to prevent from having bubbles as claimed in claim 1, wherein said communication groove is connected to a round surface above said ring plate and wherein said buffer membrane is a triangular groove including a section of said partition groove, which extends divergently towards said ring groove.

3. A rubber plug for a water ball to prevent from having bubbles as claimed in claim 1, wherein said communication groove is connected to a round surface above said ring plate; said buffer membrane is a triangular groove including a portion of said ring groove; and a surface of said communication groove is lower than said ring groove.

4. A rubber plug for a water ball to prevent from having bubbles as claimed in claim 1, wherein said partition groove between two said equal and separate glue plates has an end to meet at an intersection with other partition grooves to form into a cylindrical hole so as to provide a communication passage to all surfaces of said glue plates.

5. A rubber plug for a water ball to prevent from having bubbles as claimed in claim 1, wherein said buffer membrane extended downwards from inner side of said ring groove is substantially a concave disk, of which bottom having a flat plate.

6. A rubber plug for a water ball to prevent from having bubbles as claimed in claim 1, wherein said buffer membrane extended downwards from inner side of said ring plate is substantially a concave disk, of which bottom having a short flat surface and a salient disk.

7. A rubber plug for a water ball to prevent from having bubbles as claimed in claim 1, wherein said buffer membrane extended downwards from inner side of said ring groove is substantially a concave disk with a semi-spherical salient surface.

* * * * *